US006426730B1

(12) United States Patent
Nishizawa et al.

(10) Patent No.: US 6,426,730 B1
(45) Date of Patent: Jul. 30, 2002

(54) MULTI-FREQUENCY ARRAY ANTENNA

(75) Inventors: Kazushi Nishizawa; Hiroyuki Ohmine; Toshio Nishimura; Takashi Katagi, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/926,081

(22) PCT Filed: Dec. 26, 2000

(86) PCT No.: PCT/JP00/09271

§ 371 (c)(1),
(2), (4) Date: Aug. 27, 2001

(87) PCT Pub. No.: WO01/48868

PCT Pub. Date: Jul. 5, 2001

(30) Foreign Application Priority Data

Dec. 27, 1999 (JP) ..... 11-371039

(51) Int. Cl.[7] ..... H01Q 1/36
(52) U.S. Cl. ..... 343/795; 343/893
(58) Field of Search ..... 343/760 MS, 795, 343/824, 806, 820, 821, 822, 702, 893

(56) References Cited

U.S. PATENT DOCUMENTS 1,910,147 A * 5/1933 Bruce ..... 343/806
3,541,564 A * 11/1970 Fisk ..... 343/793
6,014,112 A * 1/2000 Koscica et al. ..... 343/795
6,292,154 B1 * 9/2001 Deguchi et al. ..... 343/806

FOREIGN PATENT DOCUMENTS

JP 5-145324 6/1993
JP 11-122030 4/1999

OTHER PUBLICATIONS

N. Goto, et al., IEICE Technical Report A. P.81–40, pp. 61–66, "Directivity of Dual Frequency Co–Planar Array Antennas", Jun. 26, 1981.

* cited by examiner

*Primary Examiner*—Don Wong
*Assistant Examiner*—James Clinger
(74) *Attorney, Agent, or Firm*—Oblon, Spivak, McClelland, Maier & Neustadt, P.C.

(57) ABSTRACT

An array antenna includes systematically arranged linear antennas belonging to two or more groups consisting of linear antennas operating at respective frequencies, so that the array antenna can operate at two or more operating frequencies. Each linear antenna that operates at a relatively low frequency includes antenna elements having cranks formed thereon.

10 Claims, 13 Drawing Sheets

MULTI-FREQUENCY ARRAY ANTENNA

This application is the national phase under 35 U.S.C. § 371 of PCT International Application No. PCT/JP00/09271 which has an International filing date of Dec. 26, 2000, which designated the United States of America and was not published in English.

TECHNICAL FIELD

The present invention relates to a multi-frequency array antenna that is used as a base station antenna in a mobile communication system, and is used in common for a plurality of frequency bands which are separated apart from each other.

BACKGROUND ART

Antennas such as base station antennas for implementing a mobile communication system are usually designed for respective frequencies to meet their specifications, and are installed individually on their sites. The base station antennas are mounted on rooftops, steel towers and the like to enable communications with mobile stations. Recently, it has been becoming increasingly difficult to secure the sites of base stations because of too many base stations, congestion of a plurality of communication systems, increasing scale of base stations, etc. Furthermore, since the steel towers for installing base station antennas are expensive, the number of base stations has to be reduced from the viewpoint of cost saving along with preventing spoiling the beauty.

The base station antennas for mobile communications employ diversity reception to improve communication quality. Although the space diversity is used most frequently as a diversity branch configuration, it requires at least two antennas separated apart by a predetermined spacing, thereby increasing the antenna installation space. As for the diversity branch to reduce the installation space, the polarization diversity is effective that utilizes the multiple propagation characteristics between different polarizations. This method becomes feasible by using an antenna for transmitting and receiving the vertically polarized waves in conjunction with an antenna for transmitting and receiving the horizontally polarized waves. In addition, utilizing both the vertically and horizontally polarized waves by a radar antenna can realize the polarimetry for identifying an object from a difference between radar cross-sectional areas caused by the polarization.

Thus, to make effective use of space, it is necessary for a single antenna to utilize a plurality of different frequencies, and in addition, the combined use of the polarized waves will further improve its function. FIG. 1 is a plan view showing a conventional two-frequency array antenna disclosed by Naohisa Goto and Kazukimi Kamiyama, "Directivity of Dual Frequency Co-Planar Array Antenna" (Technical Report A.P81-40 of the Institute of Electronics, Information and Communication Engineers of Japan, Jun. 26, 1981). FIG. 2 is a partial view of the array antenna seen looking normally to the A—A line of FIG. 1. In FIGS. 1 and 2, the reference numeral 101 designates a ground conductor; 102 designates a dipole antenna that operates at a relatively low frequency f1; 103 designates a feeder for feeding the dipole antenna 102; 104 designates a dipole antenna that operates at a relatively high frequency f2; and 105 designates a feeder for feeding the dipole antenna 104. Thus arranging the dipole antenna 102 with a resonant frequency f1 and the dipole antenna 104 with a resonant frequency f2 on the same ground conductor 101 enables the two-frequency antennas to share the aperture. Here, although the description is made taking an example of the two-frequency array antenna for convenience sake, a multi-frequency array antenna, which is constructed by arranging three or more dipole antennas with different frequency characteristics on the same ground conductor, has an analogous configuration.

Next, the operation of the conventional antenna will be described.

The dipole antenna has a rather wideband characteristic with a band width of 10% or more. To achieve such a wide bandwidth, however, it is necessary for the height from the ground conductor to the dipole antenna to be set at about a quarter wavelength of radio waves or more. Besides, since the dipole antenna forms its beam by utilizing the reflection on the ground conductor, when the height to the dipole antenna is greater than the quarter wavelength, it has a radiation pattern whose gain is dropped at the front side. Therefore, it is preferable that the height from the ground conductor to the dipole antenna be set at about a quarter of the wavelength of the target radio waves. Furthermore, as the feeders 103 and 105 for feeding the dipole antennas, a twin-lead type feeder or coaxial line is usually used. Constructing the dipole antennas using a printed circuit board consisting of a dielectric board enables the twin-lead type feeder to be formed on the printed circuit board, offering an advantage of being able to obviate soldering and to facilitate its fabrication.

As for the foregoing array antenna comprising the dipole antennas 102 and 104 working at the frequencies f1 and f2, respectively, the two dipole antennas 102 and 104 are disposed at the heights different from the ground conductor 101: The dipole antenna 104 operating at the relatively high frequency f2 is placed closer to the ground conductor 101 than the dipole antenna 102 operating at the relatively low frequency f1. Furthermore, it is necessary for the array antenna to have such element spacing that can prevent grating lobes at respective operating frequencies. Since the element spacing of the dipole antenna 102 working at the frequency f1 differs from that of the dipole antenna 104 working at the frequency f2, their adjacent elements are disposed not to be overlaid on each other, to obtain the two-frequency characteristics.

With the foregoing configuration, the conventional array antenna has the following problems when it uses two frequencies. First, since the dipole antenna operating at the relatively low frequency f1 is greater in size than the dipole antenna operating at relatively high frequency f2, the former hinders the operation of the latter. In addition, radio waves which are radiated from the latter will induce excitation current in the former when they are coupled with the former, thereby causing reradiation. Thus, another problem arises in that the radiation directivity of the dipole antenna operating at the frequency f2 is disturbed by the effect of the dipole antenna operating at the frequency f1. Here, the disturbance of the radiation directivity of the dipole antenna operating at the frequency f2 appears periodically depending on the spacing between the dipole antennas operating at the frequency f1. The periodic disturbance causes the grating lobes in the array radiation directivity as illustrated in FIG. 3.

It is possible to reduce the disturbance of the radiation directivity of the dipole antenna operating at the frequency f2 caused by the reradiation, by disposing the dipole antenna operating at the frequency f2 over the dipole antenna operating at the frequency f1. In this case, however, since the height from the ground conductor becomes greater than a quarter of the wavelength of the radio waves of the operating frequency f2, there arises another problem in that the gain at the front of the antenna is reduced, and that null points, which are brought about by the reflection on the ground conductor in wide-angle directions, result in large distortion in the radiation directivity.

The present invention is implemented to solve the foregoing problems. Therefore an object of the present invention is to provide a multi-frequency array antenna that can reduce the degradation in the radiation directivity of the dipole antenna operating at the relatively high frequency when two frequencies share the aperture in common by weakening the effect of the dipole antenna operating at the relatively low frequency on the dipole antenna operating at the relatively high frequency.

DISCLOSURE OF THE INVENTION

According to one aspect of the present invention, there is provided a multi-frequency array antenna including a ground conductor with a flat surface or a curved surface, a plurality of linear antennas each mounted on the ground conductor to operate at an operating frequency, and feeders for feeding the plurality of linear antennas, the multi-frequency array antenna comprising: an array that is composed of the plurality of linear antennas by combining a plurality of linear antenna groups for respective operating frequencies to operate at least at two frequencies, each of the linear antenna groups including a plurality of systematically arranged linear antennas that operate at a particular operating frequency; and cranks formed on antenna elements constituting the linear antennas operating at the operating frequencies lower than a maximum frequency among the plurality of operating frequencies.

This offers an advantage of being able to reduce, when the multi-frequency array antenna operates at a frequency f2 higher than a frequency f1, the degradation in the radiation directivity of the linear antennas operating at the frequency f2 because the excitation current is reduced which is induced in the linear antennas operating at the frequency f1 by the inter-element As coupling, thereby suppressing the reradiation caused by the excitation current. In addition, this offers an advantage of being able to shrink the size of the linear antennas operating at the frequency f1 as compared with a conventional ordinary linear antenna operating at the frequency f1, because the former maintains the resonant length at the frequency f1 by the length including the cranks.

Here, the cranks formed in the linear antennas operating at a first operating frequency may have a height equal to a quarter of a wavelength of radio waves of a second frequency higher than the first frequency.

This offers an advantage of being able to sharply reduce, when the multi-frequency array antenna operates at the frequency f2, the degradation in the radiation directivity of the linear antennas operating at the relatively high frequency f2, because the excitation current is reduced which is induced in the linear antennas operating at the frequency f1 by the inter-element coupling with the linear antennas operating at the frequency f2, thereby suppressing the reradiation caused by the excitation current, and because each of the linear antennas operating at the frequency f1 can be seen as divided into a plurality of linear conductors with a length less than the resonant length because its crank start points and feeding point are assumed to be open at the operating frequency f2, and hence the excitation current caused by the inter-element coupling can be more efficiently reduced at the frequency f2.

The positions of the cranks on the antenna elements of the linear antennas operating at a relatively low frequency may be adjustable in accordance with positional relationships with the linear antennas operating at a relatively high frequency.

This offers an advantage of being able to sharply reduce, when operating the multi-frequency array antenna at the frequency f2, the degradation in the radiation directivity of the linear antennas operating at the relatively high frequency f2 because the excitation current is reduced which is induced in the linear antennas operating at the frequency f1 by the inter-element coupling, thereby suppressing the reradiation caused by the excitation current, and because the excitation current caused by the inter-element coupling can be efficiently suppressed because the excitation current is canceled out at positions at which the excitation current distribution takes the maximum value.

Each of the antenna elements constituting one of the linear antennas may comprise a plurality of cranks formed on each of the antenna elements.

This offers an advantage of being able to further reduce, when the multi-frequency array antenna operates at the frequency f2, the degradation in the radiation directivity of the linear antennas operating at the relatively high frequency f2 because the excitation current, which is induced in the linear antennas operating at the frequency f1 by the inter-element coupling, is canceled out at the positions of the cranks, thereby suppressing the reradiation caused by the excitation current.

Each of the plurality of cranks formed on each of the antenna elements, which constitute the first linear antenna operating at a first operating frequency, may have a length equal to a quarter wavelength of radio waves of any one of operating frequencies higher than the first operating frequency.

This offers an advantage of being able to markedly reduce the degradation in the radiation directivity of the linear antennas operating at the relatively high frequencies because the antenna elements can be seen as divided at the relatively high frequencies, and hence the excitation current caused by the inter-element coupling can be reduce at the relatively high operating frequencies by making the individual lengths of the subdivided linear conductors equal to or less than a quarter of the wavelength of the radio waves at the operating frequencies.

Each of the linear antennas with the cranks, which operates at a frequency lower than a maximum frequency of a plurality of operating frequencies, maybe one of a Λ-shaped linear antenna and a V-shaped linear antenna, the Λ-shaped linear antenna having antenna elements forming an angle less than 180 degrees at the feeder side, and the V-shaped linear antenna having antenna elements forming an angle greater than 180 degrees at the feeder side.

This offers an advantage of being able to adjust the radiation directivity at the operating frequency f1 by changing the shape of the linear antennas in accordance with an application purpose because the Λ-shaped linear antennas will implement the radiation directivity of a wide beam at the front of the antenna at the operating frequency f1, whereas the V-shaped linear antennas will implement the radiation directivity of a narrow beam at the front of the antenna at the operating frequency f1.

Each of the antenna elements of the linear antennas with the cranks, which linear antennas operate at a frequency lower than a maximum frequency of a plurality of operating frequencies, may comprise linear conductors extending from connecting points of the cranks and a linear section of the antenna element to a direction opposite to a direction of the cranks.

This offers an advantage of being able to make impedance matching of the linear antennas with cranks operating at the frequency f1, when the multi-frequency array antenna operates at the frequency f1.

Each of the linear antennas that operate at a frequency lower than a maximum frequency of a plurality of operating frequencies may comprise an antenna element, a first half of a feeder and a crank, all of which are formed on a top surface of a dielectric board, and may comprise an antenna element, a second half of the feeder and a crank, all of which are formed on a bottom surface of the dielectric board.

This offers an advantage of being able to fabricate the linear antennas easily and accurately because the linear antennas are formed by printing them on the dielectric board by the etching process. In particular, the fabrication by the etching process is effective for an array antenna requiring a great number of antennas.

The multi-frequency array antenna may further comprise a crank length adjusting conductor provided to an upper portion of a protrusion constituting each crank formed on the antenna element.

This offers an advantage of being able to make fine adjustment of the radiation directivity of the linear antennas operating at the relatively high frequency f2 because the fine adjustment of the reradiation caused by the excitation current is made by adjusting the current excited in the linear antennas with the cranks.

Each of the cranks may comprise protrusions that are formed symmetrically with respect to a linear section of the antenna element constituting each of the linear antennas.

This offers an advantage of being able to adjust the impedance characteristics of the linear antennas with the cranks at the relatively high frequency f2 because the increasing number of the crank projections.

BEST MODE FOR CARRYING OUT THE INVENTION

The best mode for carrying out the invention will now be described with reference to accompanying drawings to explain the present invention in more detail.

EMBODIMENT 1

Figure 1:
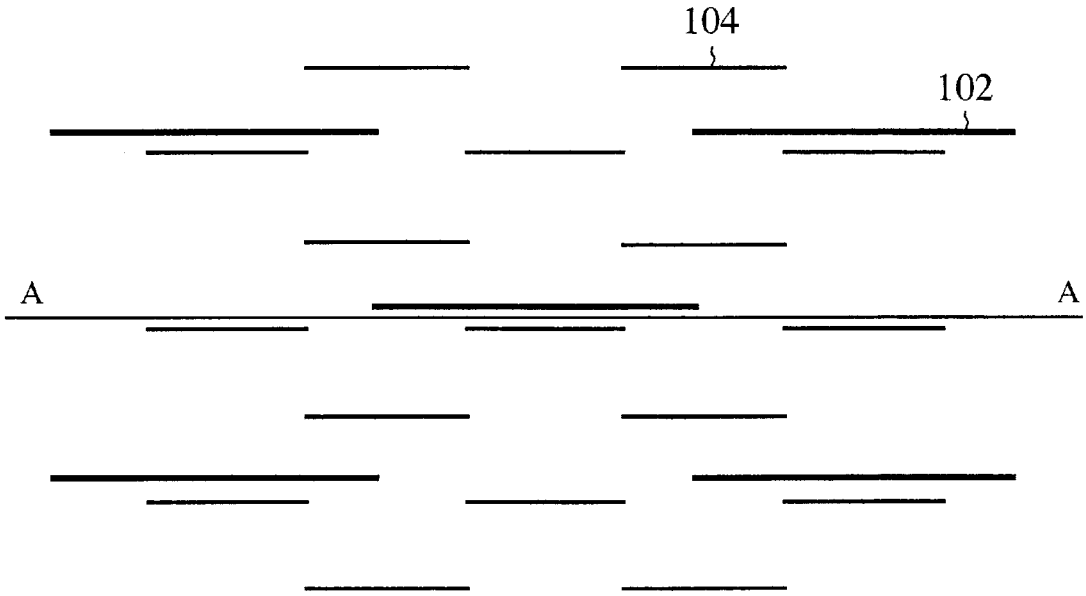
FIG. 1 is a plan view showing a conventional two-frequency array antenna.
Figure 2:
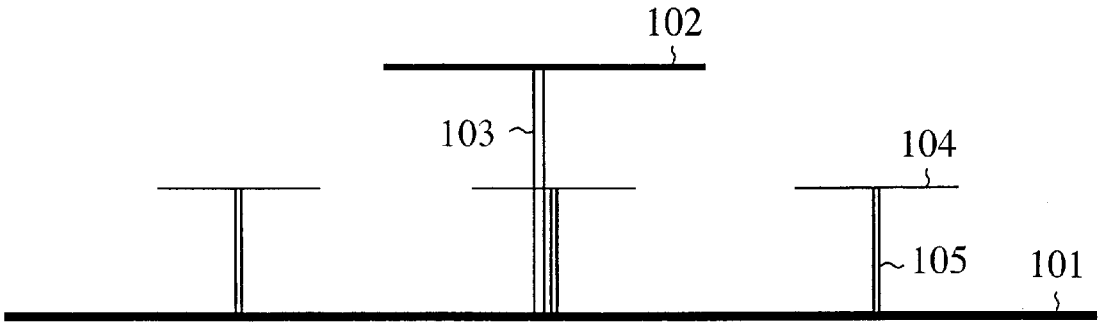
FIG. 2 is a partial view of the array antenna seen from a direction perpendicular to the A—A line of FIG. 1.
Figure 3:
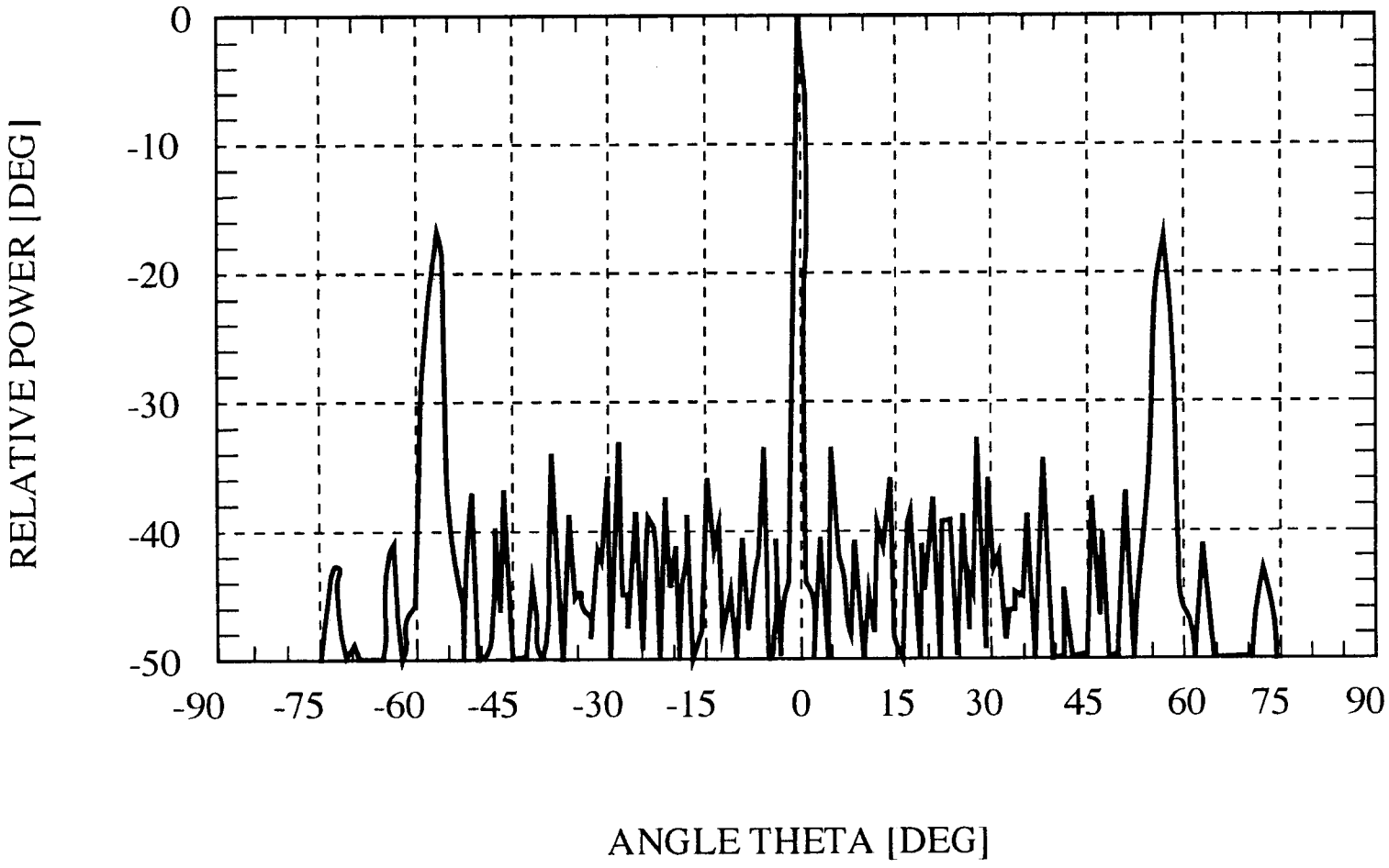
FIG. 3 is a diagram illustrating grating lobes taking place in the dipole antenna radiation directivity.
Figure 4:
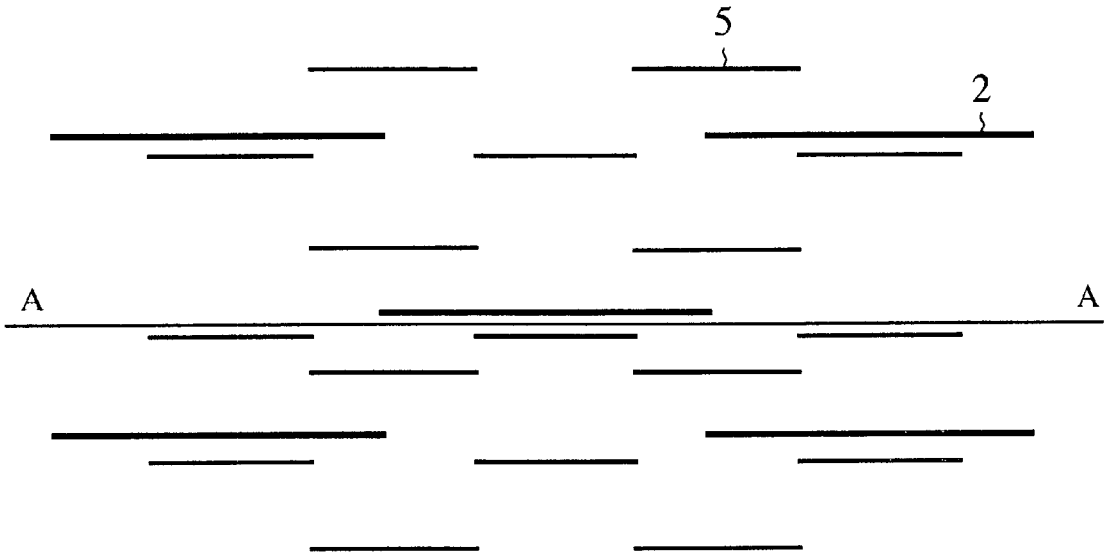
FIG. 4 is a plan view showing a configuration of an embodiment 1 of the two-frequency array antenna in accordance with the present invention.
Figure 5:
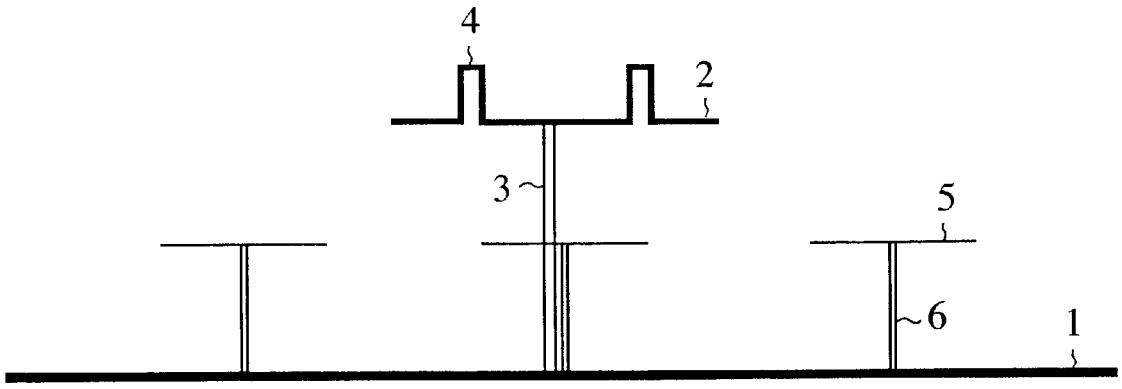
FIG. 5 is a partial view of the array antenna seen from a direction perpendicular to the A—A line of FIG. 4.

FIG. 4 is a plan view showing a configuration of a two-frequency array antenna of an embodiment 1 in accordance with the present invention; and FIG. 5 is a partial view of the array antenna seen from a direction perpendicular to the A—A line of FIG. 4. In these figures, the reference numeral 1 designates a ground conductor with a flat surface or curved surface; 2 designates a dipole antenna (linear antenna) comprising right and left dipole elements (antenna elements) operating at a relatively low frequency f1; 3 designates a feeder for feeding the dipole antenna 2; 4 designates a crank protruding at about the center of each of the right and left dipole elements of the dipole antenna 2 on both sides of the feeder 3; 5 designates a dipole antenna operating at the frequency f2 higher than the frequency f1; and 6 designates a feeder for feeding the dipole antenna 5.

Next, the operation of the present embodiment 1 will be described.

When an ordinary dipole antenna shares two frequency bands in common by the same aperture, the dipole antenna operating at the relatively low frequency f1 blocks the dipole antenna operating at the relatively high frequency f2. In addition, the mutual coupling between the two dipole antennas causes the dipole antenna operating at the frequency f1 to generate the excitation current and reradiation, thereby degrading the radiation directivity of the dipole antenna with the frequency f2.

To prevent the degradation in the radiation directivity of the dipole antenna operating at the frequency f2 without changing the heights of the dipole antennas, which operate at the respective frequencies, from the ground conductor, the protruding cranks 4 are formed on the dipole antenna 2 operating at the frequency f1 as shown in FIG. 5.

When the two-frequency array antenna of the present embodiment 1 in accordance with the present invention operates at the frequency f1, the dipole antennas 2 excited through the feeders 3 work as an ordinary dipole antenna because they have a length of about half the wavelength of the radio waves of the frequency f1, and hence resonate. Thus, the two-frequency array antenna functions as an ordinary dipole array in its entirety. On the other hand, when the two-frequency array antenna operates at the frequency f2, although the dipole antennas 5 which are excited through the feeders 6 work as an ordinary dipole antenna, part of the radiant waves are coupled with the dipole antennas 2 greater than the dipole antennas 5, thereby producing an excitation current in the dipole antennas 2. However, since the cranks 4 formed on the dipole antennas 2 suppress the amount of the excitation current, the disturbance of the radiation directivity is reduced.

Figure 6:
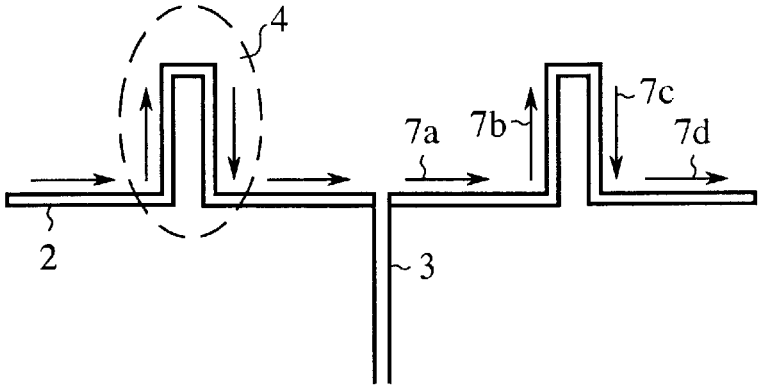
FIG. 6 is a diagram showing the flow of a current excited in a dipole antenna by inter-element coupling.
Figure 7:
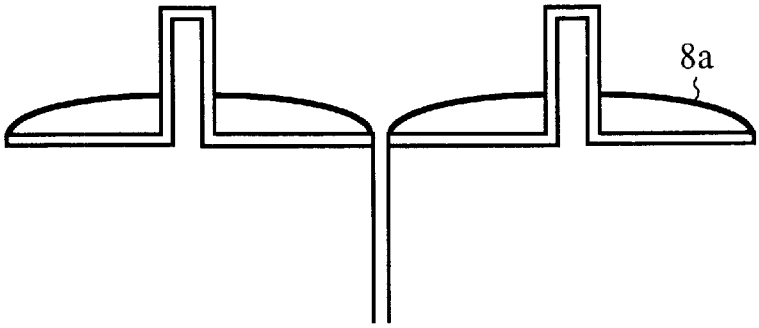
FIG. 7 is a diagram illustrating a current distribution on the dipole antenna with cranks.
Figure 8:
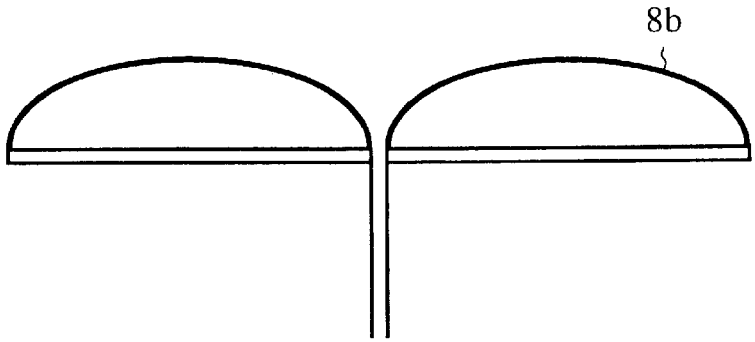
FIG. 8 is a diagram illustrating a current distribution on an ordinary dipole antenna.

Next, the principle will be described of the manner in which the cranks suppress the amount of the excitation current. FIG. 6 is a diagram showing the flow of the current excited in the dipole antenna operating at the relatively low frequency by inter-element coupling with the dipole antenna operating at the relatively high frequency; FIG. 7 is a diagram illustrating the current distribution on the dipole antenna with the cranks; and FIG. 8 is a diagram illustrating the current distribution on an ordinary dipole antenna. In these figures, arrows 7*a*, 7*b*, 7*c* and 7*d* designate the flow of the excitation current, and reference numerals 8*a* and 8*b* each designate the current distribution on the dipole antenna. Here, the cranks are each disposed at a position at which the current distribution of the excitation current becomes nearly maximum on the dipole antenna. Accordingly, as for the two-frequency array antenna of the embodiment 1 in accordance with the present invention, the cranks are formed at the center of the dipole elements of the dipole antenna. As shown in FIG. 6, since the current 7*b* and current 7*c* flow in the opposite direction on each crank, they are canceled out each other. Thus, forming the cranks at positions at which the current distribution 8*b* becomes maximum as shown in FIG. 8 enables the amount of the excitation current to be suppressed because considerable amount of the current is canceled out, thereby forming the current distribution 8*a* as shown in FIG. 7. As described above, the amount of reradiation from the dipole antenna 2 can be reduced by suppressing the amount of the excitation current. Here, it is possible for the dipole antennas having the cranks and operating at the frequency f1 to achieve the characteristics similar to those of the ordinary dipole antenna. In this case, the length of the dipole antenna that resonates with the radio waves of the frequency fi becomes equal to the length of the dipoles including the length of the cranks.

Figure 9:
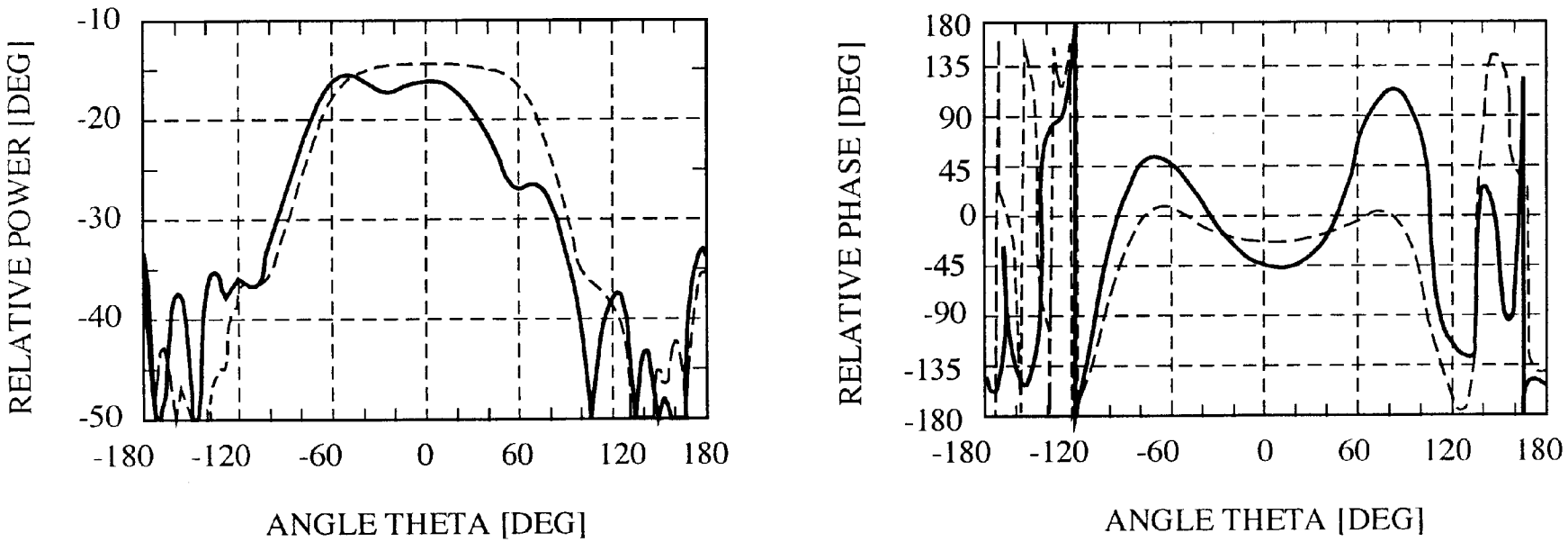
FIG. 9 is diagrams illustrating radiation directivity of a dipole antenna.
Figure 10:
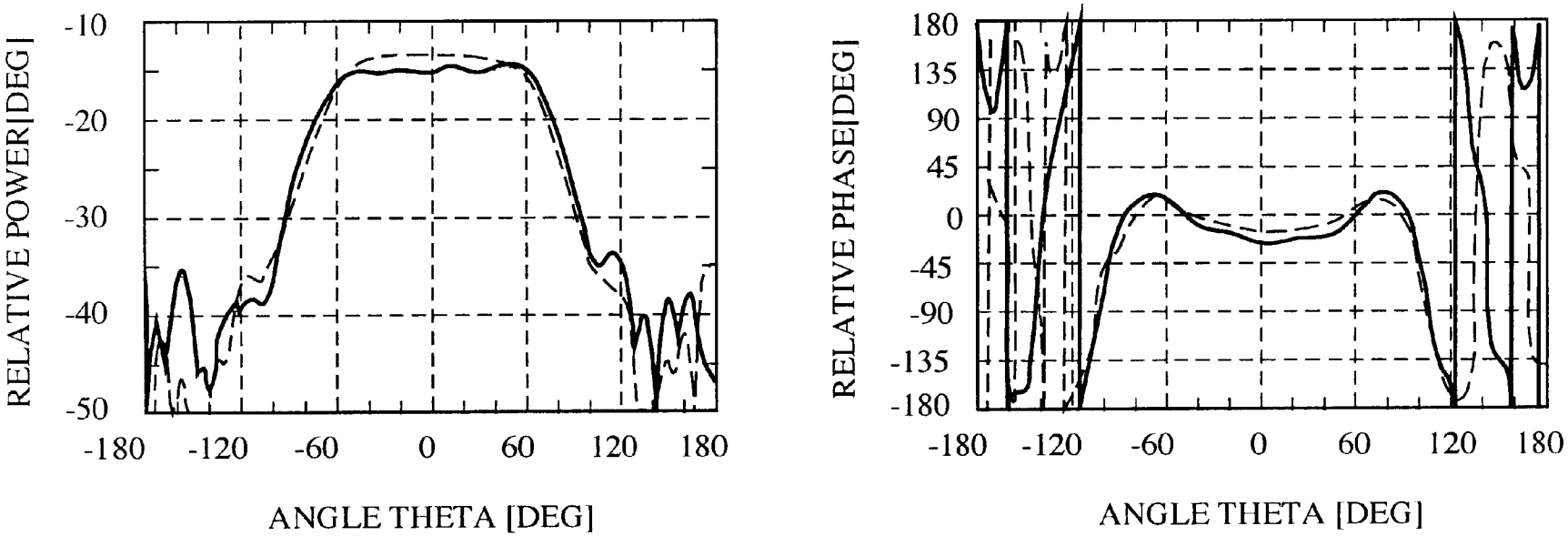
FIG. 10 is diagrams illustrating radiation directivity of a dipole antenna.

FIG. 9 is diagrams showing the radiation directivity of the dipole antennas operating at the relatively high frequency f2, when utilizing the ordinary dipole antennas operating at the relatively low frequency f1; and FIG. 10 is a diagram showing the radiation directivity of the dipole antennas operating at the relatively high frequency f2, when utilizing the dipole antennas with the cranks operating at the relatively low frequency f1. In these figures, broken lines represent the radiation directivity of the dipole antennas operating at the frequency f2 in the case where only the dipole antennas operating at the frequency f2 are installed. As clearly seen from FIGS. 9 and 10, disposing the dipole antennas with the cranks operating at the frequency f1 can reduce their adverse effect on the radiation directivity of the dipole antennas operating at the frequency f2.

Although the multi-frequency array antenna of the embodiment 1 in accordance with the present invention is described taking an example of the dipole antennas with a basic shape, the present invention is applicable to various types of the dipole antennas such as broad-width dipoles and bow-tie antennas with wide ends, by modifying their shapes.

Figure 11:
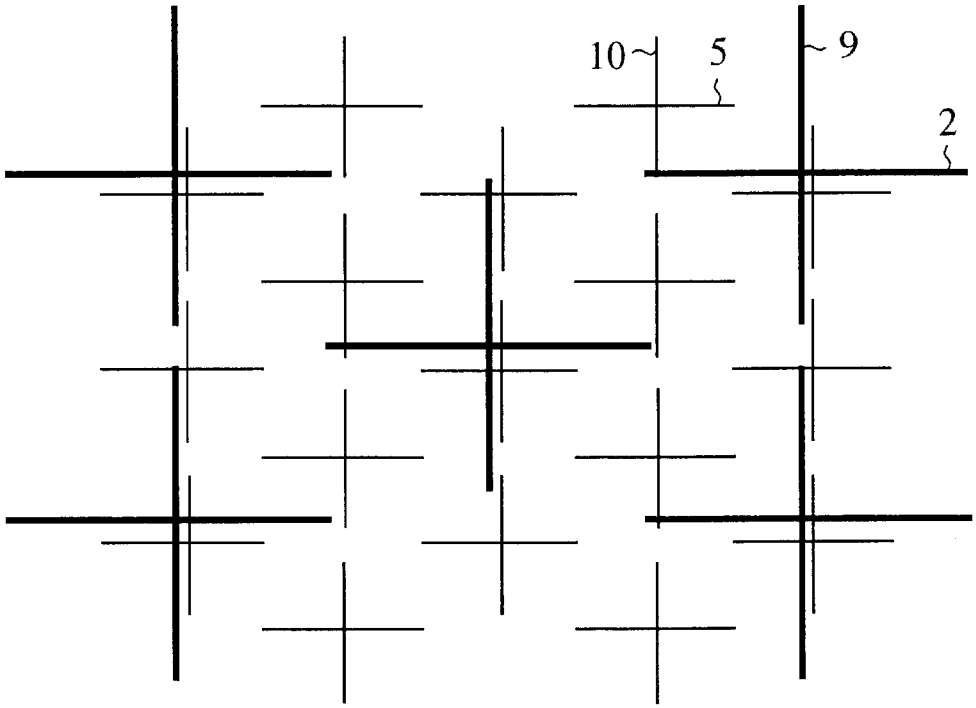
FIG. 11 is a plan view showing a configuration of an array antenna having cross polarization antennas arranged.

Next, FIG. 11 is a plan view showing a configuration of an array antenna including cross polarization antennas. In this figure, the same reference numerals designate the same or like portions to those of FIG. 4, and the description thereof is omitted here. In FIG. 11, the reference numeral 9 designates a dipole antenna that operates at the frequency f1 for transmitting and receiving radio waves orthogonally polarized with respect to the dipole antenna 2, and that has cranks just as the dipole antenna 2; and 10 designates a dipole antenna that operates at the frequency f2 for transmitting and receiving radio waves orthogonally polarized with respect to the dipole antenna 5. As shown in FIG. 11, since the dipole antennas are arranged for the two orthogonally polarized waves, the aperture can be used in common for the orthogonally polarized waves. The array antenna in FIG. 11, whose dipole antennas 2 and 9 operating at the frequency f1 have the cranks just as the array antenna as shown in FIG. 4, can also reduce the degradation in the radiation directivity of the dipole antennas 5 and 10.

Although the embodiment as shown in FIG. 11 comprises the dipole antennas for transmitting and receiving the vertically polarized waves and the dipole antennas for transmitting and receiving the horizontally polarized waves such that they cross perpendicularly to each other, this is not essential. For example, it is possible for the dipole antennas for the vertically polarized waves and the dipole antennas for the horizontally polarized waves to be placed separated apart to be excited by the orthogonally polarized waves. Alternatively, it is also possible for them to be crossed for only one of the frequencies f1 and f2. As for the arrangement of the dipole antennas, although FIG. 11 shows a triangular configuration, they may be arranged in a lattice like rectangular configuration. Thus, the present invention is applicable independently of the configurations.

As described above, according to the embodiment 1, the dipole antennas operating at the relatively low frequency f1 have the cranks so that when the two-frequency array antenna operates at the relatively high frequency f2, it can suppress the excitation current generated in the dipole antenna operating at the frequency f1 because of the inter-element coupling, thereby reducing the reradiation due to the excitation current. As a result, the present embodiment 1 offers an advantage of being able to reduce the degradation in the radiation directivity of the dipole antenna operating at the relatively high frequency f2.

Furthermore, since the dipole antennas with the cranks operating at the frequency f1 maintain the resonant length at the frequency f1, they offer an advantage of being able to shrink their size compared with the conventional dipole antennas operating at the frequency f1.

As the array antenna of the embodiment 1, although the two-frequency array antenna is described for the simplicity of explanation, the present invention is also applicable to the array antennas for three or more frequencies. In such a multi-frequency array antenna, the dipole antennas operating at frequencies lower than the maximum frequency of a plurality of operating frequencies have the cranks for reducing the degradation in the radiation directivity of the dipole antennas operating at frequencies higher than the resonant frequencies of the dipole antennas. Accordingly, when the multi-frequency array antenna operates at a particular operating frequency, the cranks which are provided for the dipole antennas operating at frequencies lower than the particular operating frequency, can reduce the degradation in the radiation directivity of the dipole antennas operating at the particular operating frequency. Furthermore, although the following embodiments are described by taking examples of the two-frequency array antenna for the simplicity sake, they can be expanded to multi-frequency array antennas for three or more operating frequencies.

EMBODIMENT 2

Figure 12:
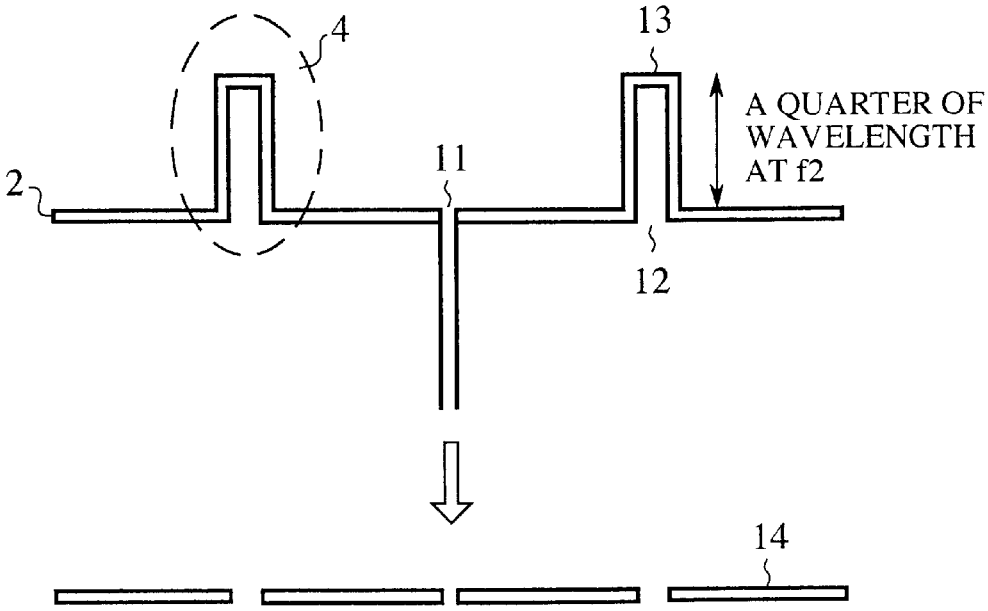
FIG. 12 is a diagram showing a configuration of a dipole antenna operating at a relatively low frequency of an embodiment 2 in accordance with the present invention.

FIG. 12 is a diagram showing a configuration of a dipole antenna operating at the relatively low frequency f1 in the embodiment 2 in accordance with the present invention 2. In this figure, the same reference numerals designate the same or like portions to those of FIG. 6, and hence the description thereof is omitted here. In FIG. 12, the reference numeral 11 designates the gap at the feeding point to the dipole; 12 designates a start point of the crank 4; 13 designate the end point of the crank 4; and 14 designates a linear conductor obtained by assuming that the dipole antenna is divided at a particular frequency. The present embodiment 2 differs from the foregoing embodiment 1 in that the length is limited of the cranks disposed at the positions near the center of the dipole elements of the dipole antenna operating at the relatively low frequency f1. More specifically, in the present embodiment 2, the crank length is made equal to a quarter of the wavelength of the radio waves of the relatively high frequency f2.

Next, the operation of the present embodiment 2 will be described.

Since the operation of the multi-frequency array antenna at the frequency f1 is the same as that of the embodiment 1, the description thereof is omitted here. On the other hand, when operating at the frequency f2, the inter-element coupling with the dipole antenna operating at the frequency f2 causes the excitation current to flow through the dipole antenna operating at the frequency f1 as shown in FIG. 12. However, the cranks 4 provided on the dipole antenna 2 can cancel out the excitation current, thereby suppressing the reradiation amount. Besides, setting the crank length at about a quarter of the wavelength of radio waves of a particular frequency (frequency f2, here), and considering that the crank end points 13 are shorted, the cranks 4 can be considered to be equivalent to a twin-lead type feeder of a quarter of the wavelength with its end shorted. This means that the cranks are each open at their start points 12 for the radio waves of the frequency f2, so that the dipole antenna with the cranks as shown in FIG. 12 can be considered to be equivalent to the linear conductor 14 including four subdivisions as shown at the bottom of FIG. 12 at the frequency f2. In this case, since the feeding point to the dipoles has the gap 11, the feeding point to the dipoles can also be considered to be open at that point. Therefore, when the subdivisions of the divided linear conductor 14 is shorter than the resonant length of the radio waves of the frequency f2, the generation of the excitation current is further suppressed. As in the foregoing embodiment 1, even when they have the cranks, the dipole antennas operating at the frequency f1 can achieve the characteristics similar to that of the ordinary multi-frequency antenna.

As described above, the present embodiment 2 is configured such that the dipole antenna operating at the relatively low frequency f1 comprises the cranks with a length of a quarter of the wavelength of radio waves of the relatively high frequency f2. Accordingly, when the multi-frequency array antenna operates at the frequency f2, the present embodiment 2 can suppress the excitation current caused by the inter-element coupling with the dipole antennas operating at the frequency f1, and suppress the reradiation due to the excitation current. Furthermore, since the crank start points and the feeding point to the dipoles are considered to be open, the dipole antennas are each divided into a plurality of linear conductors with a length less than the resonant length at the particular frequency (here, the relatively high operating frequency f2 of the multi-frequency array antenna). As a result, the present embodiment 2 offers an advantage of being able to suppress the excitation current caused by the inter-element coupling at the particular frequency, and to sharply reduce the radiation directivity of the dipole antenna operating at the relatively high frequency f2.

EMBODIMENT 3

Figure 13:
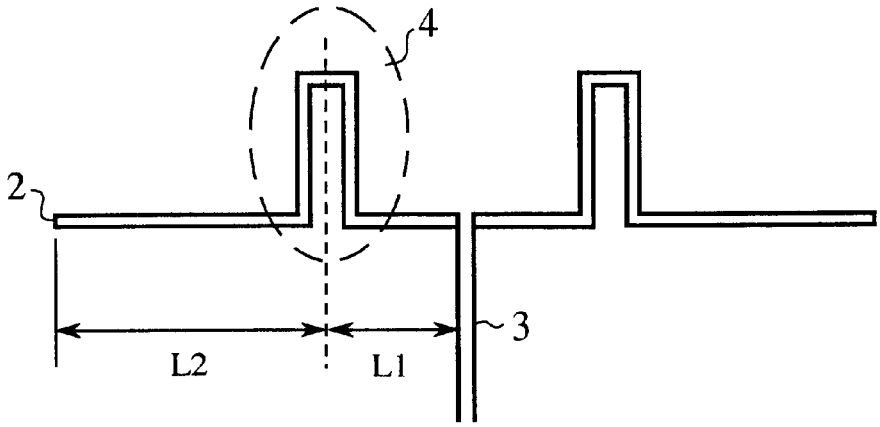
FIG. 13 is a diagram showing a configuration of a dipole antenna operating at a relatively low frequency of an embodiment 3 in accordance with the present invention.

FIG. 13 is a diagram showing a configuration of a dipole antenna operating at the relatively low frequency f1 of the embodiment 3 in accordance with the present invention. In this figure, the same reference numerals designate the same or like portions to those of FIG. 6, and the description thereof is omitted here. The present embodiment 3 differs from the foregoing embodiments 1 and 2 in that its cranks are disposed at arbitrary positions on the right and left dipole elements of the dipole antenna rather than at the positions nearly at their centers. The positions of the cranks on the dipole elements are defined by the distance L1 from the feeder 3 to the center of the crank 4 and the distance L2 from the center of the crank 4 to the end of the dipole element.

Next, the operation of the present embodiment 3 will be described.

As for the operation of the multi-frequency array antenna at the relatively low frequency f1, since it is the same as that of the embodiment 1, the description thereof is omitted here. On the other hand, when it operates at the relatively high frequency f2, the inter-element coupling with the dipole antennas operating at the frequency f2 induces the excitation current in the dipole antennas operating at the frequency f1 as illustrated in FIG. 13. However, the cranks 4 provided on the dipole antenna 2 cancel the excitation current, thereby suppressing the reradiation amount. Furthermore, in the multi-frequency array antenna, since the inter-element coupling between the dipole antennas operating at the frequency f2 and the dipole antennas with the cranks varies depending on the positional relationships between the dipole antennas with the cranks and the dipole antennas operating at the frequency f2, the excitation current distribution profiles (maximum positions of the current distribution) on the dipole antennas with the cranks vary with the dipole elements. For example, when the dipole antennas operating at the frequency f2 are placed right under the dipole antennas with the cranks, the maximum values of the excitation current distribution on the dipole antennas with the cranks will shift toward the feeder 3. Accordingly, shifting the positions of the cranks 4 toward the feeder 3 as illustrated in FIG. 13 enables the excitation currents with the opposite phase to be canceled at the position where the excitation current distribution takes the maximum value. Here, as in the embodiment 1, the dipole antenna with the cranks operating at the frequency f1 can achieve the same characteristics as the ordinary dipole antenna without the cranks. Besides, although the cranks of FIG. 13 are formed at the positions symmetric with respect to the midpoint of the dipole antenna, they can be formed at asymmetric positions.

As described above, the embodiment 3 is configured such that the positions of the cranks in the dipole antennas operating at the frequency f1 are adjusted in accordance with the positions of the dipole antennas with the cranks within the multi-frequency array antenna. Accordingly, when the multi-frequency array antenna operates at the frequency f2, the present embodiment 3 can suppress the excitation current induced in the dipole antennas operating at the frequency f1 by the inter-element coupling, and the reradiation caused by the excitation current. Furthermore, since the excitation current induced by the inter-element coupling can be effectively suppressed by canceling the excitation current at the positions at which the excitation current distribution takes the maximum values, the present embodiment 3 offers an advantage of being able to sharply reduce the degradation in the radiation directivity of the dipole antenna operating at the relatively high frequency f2.

In addition, adjusting the positions of the cranks of each dipole antenna operating at the frequency f1 in the multi-frequency array antenna can efficiently reduce the effect of the excitation current on the radiation directivity of the dipole antenna operating at the frequency f2. Thus, the present embodiment 3 offers an advantage of being able to suppress the grating lobes involved in the periodicity of the aperture distribution based on the configuration of the dipole antennas that have different operating frequencies and are mounted on the ground conductor.

EMBODIMENT 4

Figure 14:
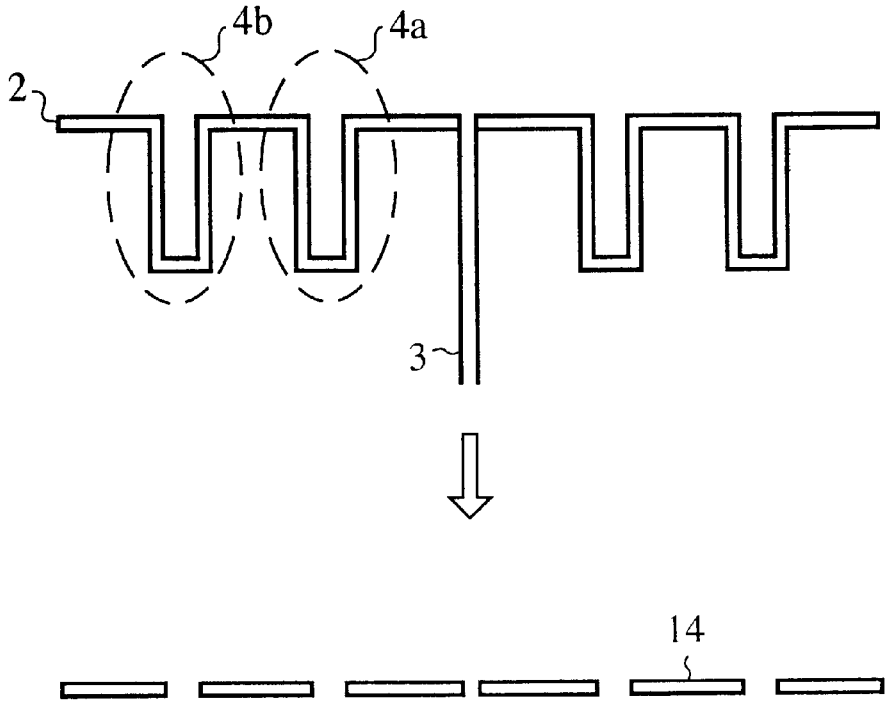
FIG. 14 is a diagram showing a configuration of a dipole antenna operating at a relatively low frequency of an embodiment 4 in accordance with the present invention.

FIG. 14 is a diagram showing a configuration of a dipole antenna operating at the relatively low frequency f1 of the embodiment 4 in accordance with the present invention. In this figure, the same reference numerals designate the same or like portions to those of FIG. 6, and the description thereof is omitted here. In this figure, reference numerals 4*a* and 4*b* designate cranks that are formed on each of the right and left dipole elements that constitute the dipole antenna 2 operating at the relatively low frequency f1 together with the feeder 3.

The present embodiment 4 differs from the foregoing embodiments 1–3 in that the plurality of cranks are formed on each of the right and left dipole elements about the feeder 3. Unlike the cranks formed in the dipole antenna of the foregoing embodiments 1–3, the cranks of FIG. 14 are formed downward from the dipole elements. However, this presents the same results as when they are formed upward.

Next, the operation of the present embodiment 4 will be described.

Since the operation of the multi-frequency array antenna at the relatively low frequency f1 is the same as that of the foregoing embodiment 1, the description thereof is omitted here. On the other hand, when it operates at the relatively high frequency f2, the inter-element coupling with the dipole antenna operating at the frequency f2 induces the excitation current in the dipole antenna operating at the frequency f1 as shown in FIG. 14. If the relationship f2>3 f1 holds between the frequency f1 and the frequency f2, it is not enough to provide only one crank to each of the right and left dipole elements of the dipole antenna as described in the foregoing embodiments 1–3. This is because the lengths of the linear conductors obtained by dividing the dipole elements become about half the wavelength of the radio waves of the frequency f2, and hence they cannot sufficiently suppress the excitation current in the dipole antenna 2. Taking account of this, the dipole antenna of the present embodiment 4 as shown in FIG. 14 comprises the plurality of cranks 4*a* and 4*b* formed on each side of the dipole elements. This makes it possible for the linear conductors, which are assumed to be obtained at the frequency f2 by dividing the dipole antenna 2 as illustrated at the bottom of FIG. 14, to reduce their lengths to less than a quarter of the wavelength of the radio waves of the frequency f2, thereby preventing the excitation current from being induced in the dipole antenna 2. In addition, even when the frequency f1 and the frequency f2 do not satisfy the relationship f2>3 f1, an increasing number of the cranks formed in the dipole elements enables the excitation current to be canceled out at the positions equal to the number of cranks. Thus, the present embodiment 4 can further reduce the excitation current resulting from the inter-element coupling with the dipole antenna operating at the frequency f2. Here, as in the foregoing embodiment 1, the dipole antennas with the cranks operating at the frequency f1 can achieve the characteristics similar to those of the ordinary dipole antennas without the cranks.

Figure 15:
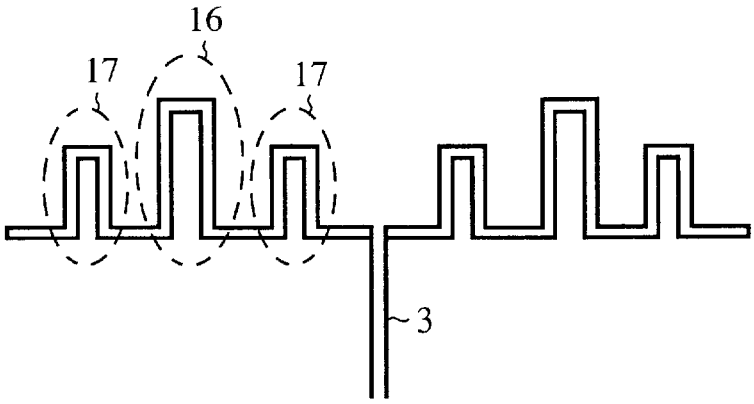
FIG. 15 is a diagram showing another configuration of the dipole antenna operating at the relatively low frequency of the embodiment 4 in accordance with the present invention.

Although the cranks of the dipole antennas of the present embodiment 4 as shown in FIG. 14 have the same length, this is not essential. For example, a multi-frequency antenna for three or more frequencies can be configured by forming the cranks of different lengths on the dipole elements. FIG. 15 is a diagram showing a configuration of the dipole antenna operating at the lowest frequency f1 in the multi-frequency array antenna. In this figure, the reference numeral 16 designates a crank for canceling out the excitation current caused by the frequency f2 higher than the lowest frequency f1; and 17 designates a crank for canceling out the excitation current induced by a frequency f3 higher than the frequency f2. As shown in this figure, by adjusting the length of the cranks in response to the operating frequencies, the excitation current corresponding to the operating frequencies is canceled out. Thus, forming the cranks with different size makes it possible to suppress the excitation current in the multi-frequency array antenna.

As described above, the present embodiment 4 is configured such that the dipole antennas operating at the relatively low frequencies comprise a plurality of cranks with a length of a quarter wavelength of the radio waves of the relatively higher operating frequencies. Thus, when the multi-frequency array antenna operated at the relatively high frequency, the excitation current, which is induced in the dipole antenna operating at the frequency f1 by the inter-element coupling, is canceled out at the positions of the cranks, thereby suppressing the reradiation caused by the excitation current. Furthermore, setting the length of the linear conductors, which are obtained for the operating frequency by assumedly dividing the dipole elements, at less than a quarter of the wavelength of the radio waves of the operating frequency enables the excitation current due to the inter-element coupling to be suppressed more at the operating frequency. As a result, the present embodiment 4 offers an advantage of being able to sharply reduce the degradation in the radiation directivity of the dipole antennas operating at the relatively high frequency f2 (f3).

EMBODIMENT 5

Figure 16:
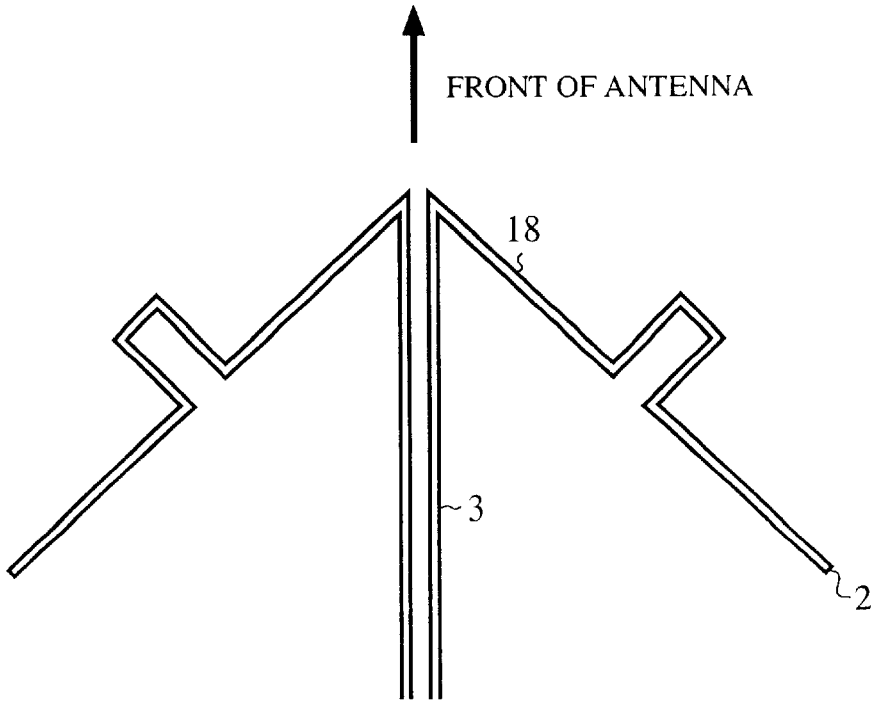
FIG. 16 is a diagram showing a configuration of a dipole antenna operating at a relatively low frequency of an embodiment 5 in accordance with the present invention.

FIG. 16 is a diagram showing a configuration of a dipole antenna operating at the relatively low frequency f1 of the embodiment 5 in accordance with the present invention. In this figure, the same reference numerals designate the same or like portions to those of FIG. 6, and hence the description thereof is omitted here. In this figure, the reference numeral 18 designates a dipole element constituting the dipole antenna 2 operating at the relatively low frequency f1. The embodiment 5 differs from the foregoing embodiments 1–4 in that its right and left dipole elements constituting the dipole antenna do not form 180 degrees.

Next, the operation of the present embodiment 5 will be described.

As for the suppression of the excitation current induced by the inter-element coupling when the multi-frequency array antenna operates at the relatively high frequency f2, since it is the same as that of the foregoing embodiment 1, the description thereof is omitted here. On the other hand, when the multi-frequency array antenna operates at the frequency f1, since the dipole antenna 2 is Λ-shaped, in which the dipole elements on both sides of the feeder 3 form an angle of less than 180 degrees, the radiation directivity of the dipole antenna 2 at the operating frequency f1 has a wide beam characteristic in front of the antenna as shown in FIG. 16.

Figure 17:
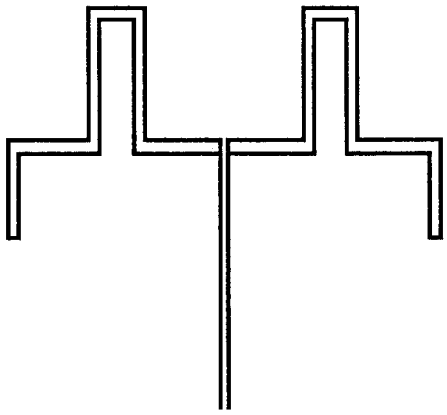
FIG. 17 is a diagram showing another configuration of the dipole antenna operating at the relatively low frequency of the embodiment 5 in accordance with the present invention.
Figure 18:
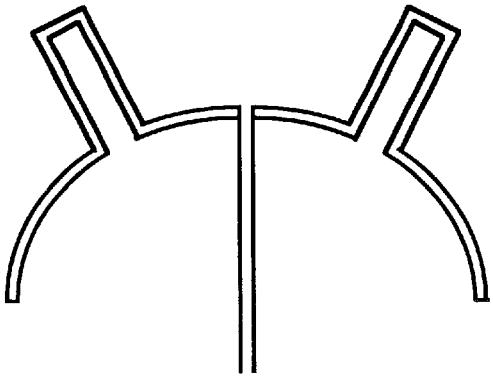
FIG. 18 is a diagram showing still another configuration of the dipole antenna operating at the relatively low frequency of the embodiment 5 in accordance with the present invention.

In contrast, when the dipole antenna 2 is V-shaped, in which the dipole elements on both sides of the feeder 3 forms an angle equal to or greater than 180 degrees at the feeder side, the radiation directivity of the dipole antenna 2 at the operating frequency f1 has a narrow beam characteristic in front of the antenna as shown in FIG. 16. Thus, the radiation directivity can be adjusted appropriately by varying the shape of the dipole antenna. The shape of the dipole antenna is not limited to the Λ-shaped or V-shaped structure. For example, the dipole antenna with a shape as shown in FIG. 17 or 18 is also possible.

As described above, according to the embodiment 5, the dipole antenna with the cranks has a Λ-shaped or V-shaped structure. Thus, the present embodiment 5 offers an advantage of being able to reduce the deterioration in the radiation directivity of the dipole antenna operating at the relatively high frequency f2, and to appropriately adjust the width of the beam of the dipole antenna operating at the relatively low frequency f1 in accordance with an application purpose.

EMBODIMENT 6

Figure 19:
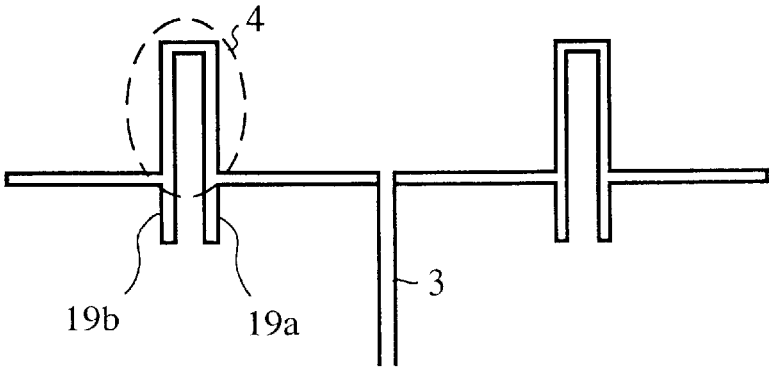
FIG. 19 is a diagram showing a configuration of a dipole antenna operating at a relatively low frequency of an embodiment 6 in accordance with the present invention.

FIG. 19 is a diagram showing a configuration of a dipole antenna operating at the relatively low frequency f1 of the embodiment 6 in accordance with the present invention. In this figure, the same reference numerals designate the same or like portions to those of FIG. 6, and the description thereof is omitted here. In FIG. 19, reference numerals 19*a* and 19*b* each designate a linear conductor with an arbitrary length that is extended from the connecting point of the linear section of the dipole antenna 2 and a crank in the direction opposite to the crank. The present embodiment 6 differs from the foregoing embodiments 1–5 in that the linear conductors are extended from the bottom of the crank.

Next, the operation of the present embodiment 6 will be described.

Since the operation of the multi-frequency array antenna at the relatively high frequency f2 to suppress the excitation current caused by the inter-element coupling is the same as that of the embodiment 1, the description thereof is omitted here. On the other hand, when operating the multi-frequency array antenna at the relatively low frequency f1, the linear conductors 19*a* and 19*b*, which extend from the connecting points of the linear section of the dipole antenna 2 and the crank 4, vary the passage of the flow of the current supplied from the feeder 3 as compared with that of the dipole antennas 2 of the embodiment 1, resulting in the shift of the resonant frequency. Thus, adjusting the length of the linear conductors 19*a* and 19*b* enables the impedance matching at the frequency f1. Here, when the multi-frequency array antenna operates at the relatively high frequency f2, the linear conductors 19*a* and 19*b* have little effect on the radiation directivity of the dipole antenna operating at the frequency f2 because the opposing structure of the linear conductors 19*a* and 19*b* can cancel out the excitation current induced by the inter-element coupling.

As described above, the present embodiment 6 is configured such that the linear conductors are extended from the connecting points of the cranks and the linear section of the dipole antenna with the cranks. Thus, besides the advantages of the foregoing embodiment 1, the present embodiment 6 offers an advantage of being able to establish the impedance matching when the multi-frequency array antenna operates at the relatively low frequency f1.

EMBODIMENT 7

Figure 20:
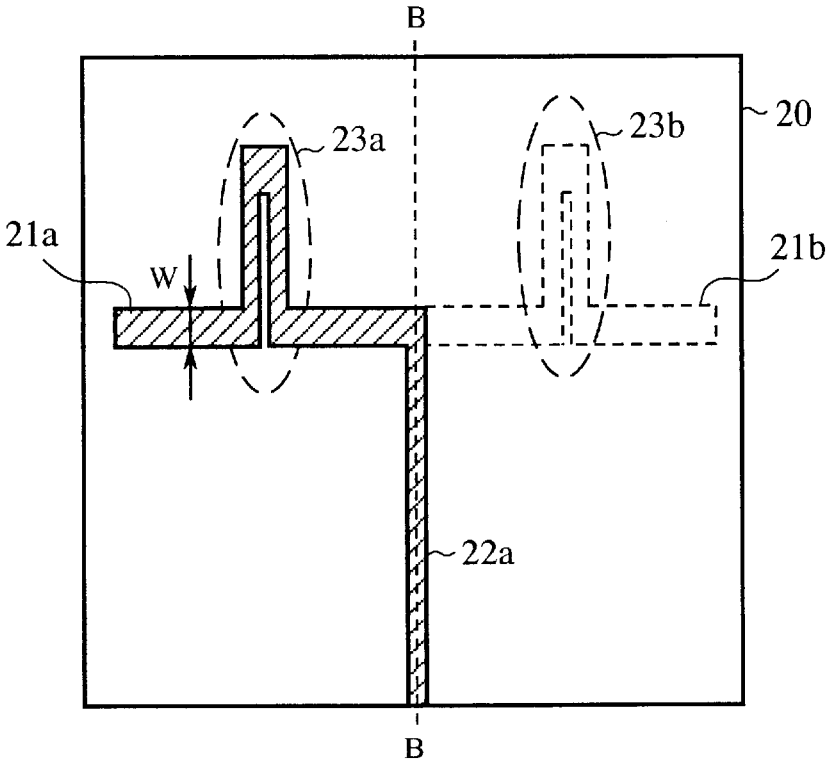
FIG. 20 is a diagram showing a configuration of a dipole antenna operating at a relatively low frequency of an embodiment 7 in accordance with the present invention.
Figure 21:
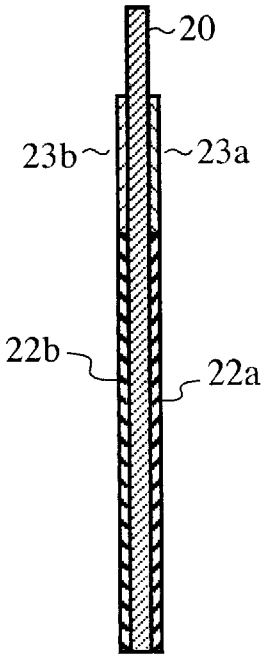
FIG. 21 is a cross-sectional view taken along the line B—B of FIG. 20.

FIG. 20 is a plan view showing a configuration of a dipole antenna operating at the relatively low frequency f1 of the embodiment 7 in accordance with the present invention; and FIG. 21 is a cross-sectional view taken along the line B—B of FIG. 20. In these figures, the reference numeral 20 designates a dielectric board; 21*a* designates a dipole element etched on the top surface of the dielectric board 20; 21*b* designates a dipole element etched on the bottom surface of the dielectric board 20; 22*a* designates a feeder etched on the top surface of the dielectric board 20; 22*b* designates a feeder etched on the bottom surface of the dielectric board 20; 23*a* designates a crank etched on the top surface of the dielectric board 20; and 23*b* designates a crank etched on the bottom surface of the dielectric board 20. Here, the feeder 22*a* and the feeder 22*b* constitute a twin-lead type feeder, and the dipole elements 21*a* and 21*b* formed on the top and bottom surface of the dielectric board 20 constitute a dipole antenna. The present embodiment 7 differs from the foregoing embodiments 1–6 in that the dipole antenna is composed of the printed circuit formed on the dielectric board rather than of the linear conductors.

Next, the operation of the present embodiment 7 will be described.

The dipole antenna is fabricated by integrally forming the dipole elements 21*a* and 21*b*, the feeders 22*a* and 22*b*, and the cranks 23*a* and 23*b* on the dielectric board (printed circuit board) 20 by the etching process. The cranks 23*a* and 23*b*, which are formed on the dipole elements 21*a* and 21*b*, respectively, can be produced by forming protrusions from the dipole elements 21*a* and 21*b* on the dielectric board 20 by printing, followed by forming a slit at the center of each of the protrusions. Both the dipole elements 21*a* and 21*b* are formed to have a width of W which will increase the bandwidth of the dipole antenna when increased. Thus, the wideband dipole antenna can be easily formed on the dielectric board by printing the dipole. Furthermore, the array antenna can be fabricated by forming a plurality of dipole antennas on the dielectric board 20 by the printing process.

When the dipole antenna with the cranks operates at the operating frequency f1, it resonates in the same manner as the dipole antenna of the foregoing embodiment 1, thus functioning as the ordinary dipole antenna.

On the other hand, when operating at the frequency f2, the dipole antenna with the cranks suppresses the excitation current by canceling out the current in the cranks, which is induced by the inter-element coupling with the dipole antenna operating at relatively high the frequency f2, in the same manner as the dipole antenna of the embodiment 1, thereby reducing the disturbance of the radiation directivity of the dipole antenna operating at the frequency f2. As in the embodiment 1, the dipole antenna with the cranks operating at the frequency f1 can achieve the same characteristics as those of the ordinary dipole antenna.

In addition, varying the length of the slit of the cranks 23*a* and 23*b* makes it possible to adjust the crank length: For example, adjusting the crank length at a quarter of the wavelength of the radio waves of the relatively high frequency f2 enables the excitation current to be further reduced as in the foregoing embodiment 2, in which the crank start points will be opened for the radio waves of the frequency f2. Furthermore, shifting the positions of the cranks 23*a* and 23*b* of the dipole elements 21*a* and 21*b* can further reduce the excitation current as in the foregoing embodiment 3, in which the excitation current is canceled out at the positions at which the excitation current distribution becomes maximum. Moreover, the printing on the dielectric board 20 makes it possible to form the plurality of cranks of the dipole elements as in the embodiment 4, to form the Λ-shaped or V-shaped dipole antenna as in the embodiment 5, and to extend the linear conductors from the bottom of the cranks as in the embodiment 6. In these cases, since their operations are the same as those described in the individual embodiments, the description thereof is omitted here.

As described above, the embodiment 7 has an advantage, in addition to the advantages of the embodiments 1–6, that the dipole antenna can be fabricated easily and accurately by printing the dipole antenna on the dielectric board by the etching process. In particular, as for the array antenna requiring a great number of antennas, the etching process has a great advantage in the fabrication.

EMBODIMENT 8

Figure 22:
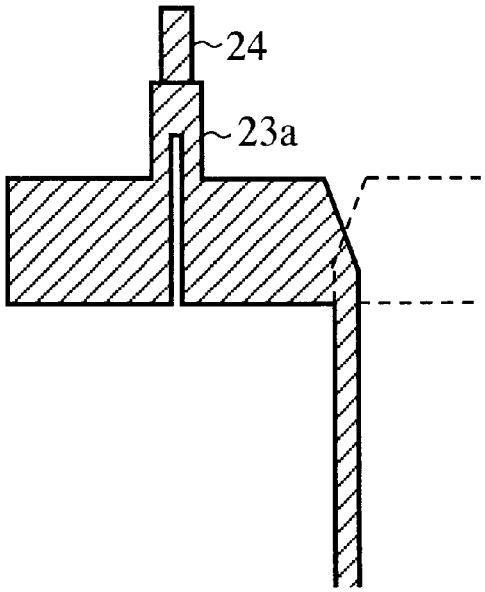
FIG. 22 is a diagram showing a configuration of a dipole antenna operating at a relatively low frequency of an embodiment 8 in accordance with the present invention.

FIG. 22 is a diagram showing a configuration of a dipole antenna operating at the relatively low frequency f1 of the embodiment 8 in accordance with the present invention. In this figure, the same reference numerals designate the same or like portions to those of FIG. 20, and hence the description thereof is omitted here. In FIG. 22, the reference numeral 24 designates a crank length adjusting conductor provided on top of the crank 23*a*. The present embodiment 8 differs from the embodiment 7 in that the length of the crank projection is adjustable. Although only one side of the dipole elements constituting the dipole antenna is shown in FIG. 22, the crank length adjusting conductors 24 are formed on both sides of the dipole elements.

Next, the operation of the present embodiment 8 will be described.

Since the operation of the multi-frequency array antenna at the relatively low frequency f1 is the same as that of the embodiment 1, the description thereof is omitted here. On the other hand, when operating at the relatively high frequency f2, the dipole antenna operating at the frequency f1 as shown in FIG. 22 has the excitation current induced by the inter-element coupling with the dipole antenna operating at the frequency f2. However, the cranks 23*a* of the dipole antenna can cancel out the excitation current, and hence suppress the reradiation amount. In addition, the crank length adjusting conductors 24 at the top of the protrusions constituting the cranks 23*a* can carry out the fine adjustment of the radiation directivity of the dipole antenna operating at the frequency f2. In other words, providing the upper portion of each crank projection with the crank length adjusting conductor makes is possible to adjust the passage of the current excited in the dipole antenna by the cranks. Thus, the radiation directivity of the dipole antenna operating at the frequency f2, which is affected by the slight reradiation from the dipole antenna with the cranks, can undergo the fine adjustment.

As described above, the embodiment 8 is configured such that it comprises the crank length adjusting conductors at the upper portions of the crank projections. As a result, in addition to the advantages of the embodiment 7, the present embodiment 8 offers an advantage of being able to make the fine adjustment of the radiation directivity operating at the relatively high frequency f2 to a desired shape.

EMBODIMENT 9

Figure 23:
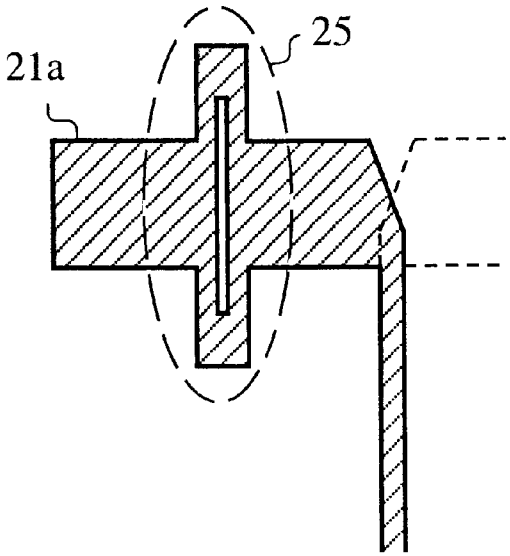
FIG. 23 is a diagram showing a configuration of a dipole antenna operating at a relatively low frequency of an embodiment 9 in accordance with the present invention.
Figure 24:
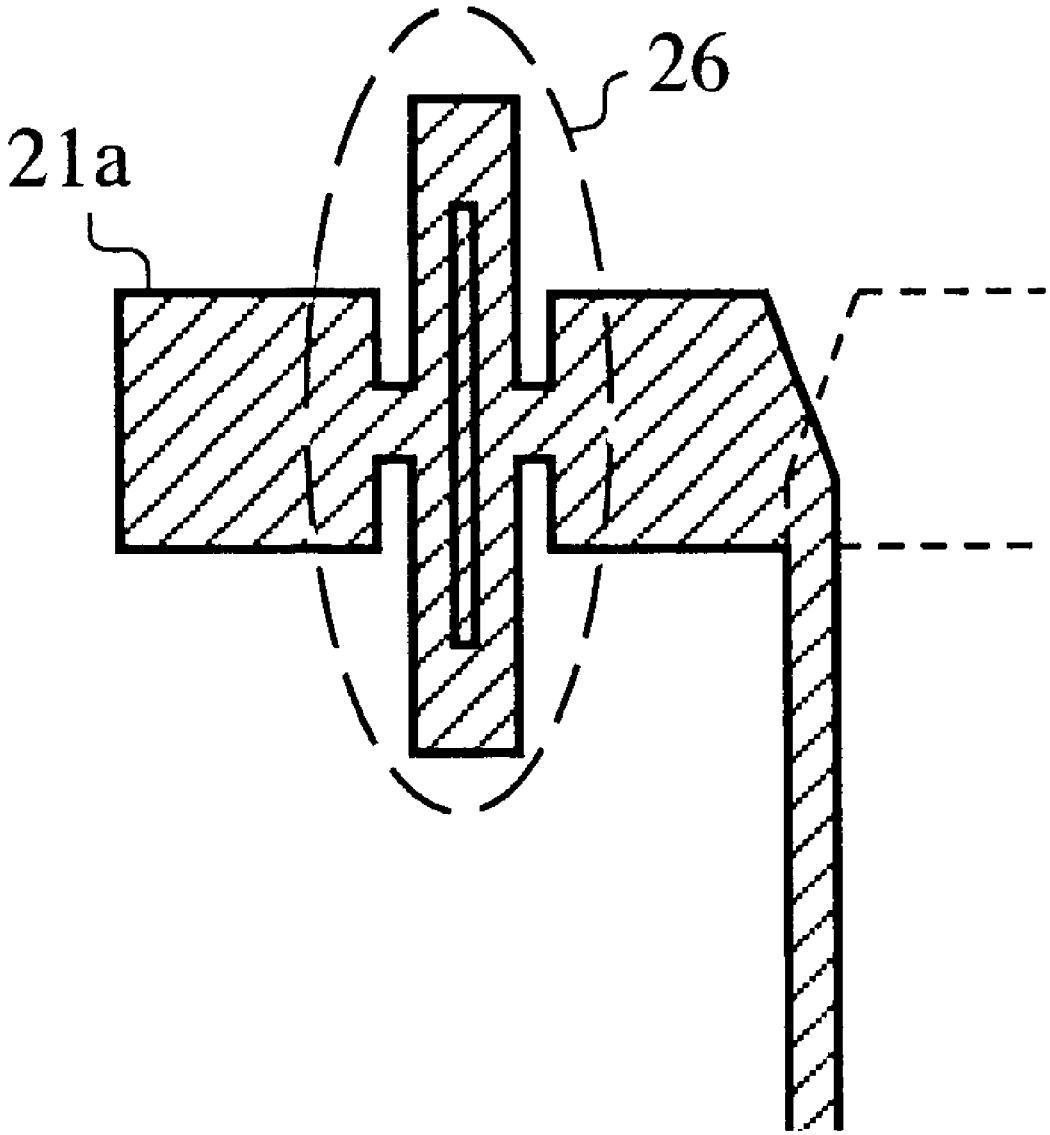
FIG. 24 is a diagram showing another configuration of the dipole antenna operating at the relatively low frequency of the embodiment 9 in accordance with the present invention.

FIG. 23 is a diagram showing a configuration of a dipole antenna operating at the relatively low frequency f1 of the embodiment 9 in accordance with the present invention; and FIG. 24 is a diagram showing another configuration of the dipole antenna operating at the relatively low frequency f1 of the embodiment 9 in accordance with the present invention. In these figures, the same reference numerals designate the same or like portions to those of FIG. 20, and the description thereof is omitted here. In these figures, reference numerals 25 and 26 each designate a crank with protrusions that are symmetric with respect to the linear section of the dipole elements constituting the dipole antenna. The present embodiment 9 differs from the embodiment 7 in that it comprises cranks consisting of the protrusions that are symmetric with respect to the linear section of the dipole elements constituting the dipole antenna.

Next, the operation of the present embodiment 9 will be described.

Since the operation of the multi-frequency array antenna at the relatively low frequency f1 is the same as that of the embodiment 1, the description thereof is omitted here. On the other hand, when operating at the relatively high frequency f2, the dipole antennas operating at the frequency f1 as shown in FIGS. 23 and 24 have the excitation current generated by the inter-element coupling with the dipole antenna operating at the frequency f2. However, the cranks 25 and 26 the dipole antennas comprise cancel out the excitation current, thereby suppressing the reradiation amount. In addition, since the protrusions constituting the cranks 25 and 26 are symmetrically formed with respect to the linear section of the dipole elements of the dipole antenna, the inductance based on the cranks can be adjusted by the two protrusions. In other words, varying the shape of the protrusions makes it possible to adjust the impedance characteristics, and hence increases the degree of flexibility in adjusting the impedance characteristics of the dipole antenna with the cranks for the band of the relatively high frequency f2 by increasing the number of crank projections. In this case, as in the embodiment 1, the dipole antennas with the cranks operating at the frequency f1 can achieve the characteristics similar to the ordinary dipole antenna without the cranks.

As described above, since the embodiment 9 comprises the protrusions constituting the cranks in such a manner that the protrusions are symmetric with respect to the linear section of the dipole elements of the dipole antenna, the number of the crank projections is increased. Thus, the present embodiment 9 offers an advantage in addition to the advantages of the embodiment 7 that it can adjust the impedance characteristics of the antenna with the cranks for the relatively high frequency f2.

INDUSTRIAL APPLICABILITY

As described above, the multi-frequency array antenna in accordance with the present invention is appropriate for reducing the degradation in the radiation directivity of the dipole antenna operating at the relatively high frequency when its aperture is shared by two or more frequencies.

What is claimed is:

1. A multi-frequency array antenna comprising:

a ground conductor having at least one of a flat surface and a curved surface;

a plurality of linear-shape antennas, each linear-shape antenna mounted on said ground conductor and configured to operate at an operating frequency;

feeders configured to feed said plurality of linear-shape antennas;

an array formed by combining the plurality of linear-shape antennas into a plurality of linear-shape antenna groups, said groups configured to operate at least at two frequencies; and cranks formed on antenna elements of a lower-frequency set of the linear-shape antennas, said lower-frequency set configured to operate at a lower frequency than a maximum frequency among a plurality of operating frequencies of the linear-shape antennas, said cranks are configured to suppress excitation current induced on said lower-frequency set by radiation from a higher-frequency set of linear-shape antennas radiating at frequencies higher than said lower frequency.

2. The multi-frequency array antenna according to claim 1, wherein said cranks are formed in the linear-shape antennas operating at a first operating frequency and have a height equal to a quarter of a wavelength of radio waves of a second frequency higher than the first operating frequency.

3. The multi-frequency array antenna according to claim 1, wherein positions of said cranks on the antenna elements of the linear-shape antennas operating at the lower frequency are adjustable in accordance with positional relationships with linear-shape antennas operating at a higher frequency than the lower frequency.

4. The multi-frequency array antenna according to claim 1, wherein each of said antenna elements includes a plurality of said cranks.

5. The multi-frequency array antenna according to claim 4, wherein each of said plurality of said cranks, formed on a first linear-shape antenna configured to operate at a first operating frequency, has a length equal to a quarter wavelength of radio waves of any one of said plurality of operating frequencies higher than the first operating frequency.

6. The multi-frequency array antenna according to claim 1, wherein each of said linear-shape antennas with the cranks comprises:

one of a Λ-configured linear antenna having antenna elements forming an angle less than 180 degrees at a feeder side of said linear-shape antennas and a V-configured linear antenna having antenna elements forming an angle greater than 180 degrees at the feeder side.

7. The multi-frequency array antenna according to claim 1, wherein each of said antenna elements of said linear antennas with the cranks, which linear antennas operate at a frequency lower than a maximum frequency of a plurality of operating frequencies, comprises linear conductors extending from connecting points of said cranks and a linear section of the antenna element to a direction opposite to a direction of said cranks.

8. The multi-frequency array antenna according to claim 1, wherein each of said lower-frequency set of linear-shape antennas comprises:

a first antenna element;

a first half of a feeder and a first crank, all of which are formed on a top surface of a dielectric board; and a second antenna element and a second half of the feeder and a second crank, all of which are formed on a bottom surface of a dielectric board.

9. The multi-frequency array antenna according to claim 8, further comprising:

a crank length adjusting conductor provided to an upper portion of a protrusion configured as the crank formed on the antenna element.

10. The multi-frequency array antenna according to claim 8, wherein each of said cranks comprises:

protrusions formed symmetrically with respect to a linear section of the antenna element of said linear-shape antennas.

* * * * *